US006446280B1

(12) United States Patent
Moore, Jr.

(10) Patent No.: US 6,446,280 B1
(45) Date of Patent: Sep. 10, 2002

(54) SINK ATTACHMENT

(76) Inventor: Robert F. Moore, Jr., 5R Atkinson Rd., Salem, NH (US) 03079

( * ) Notice: Subject to any disclaimer, the term of this patent is extended or adjusted under 35 U.S.C. 154(b) by 0 days.

(21) Appl. No.: 09/754,673

(22) Filed: Jan. 4, 2001

(51) Int. Cl.[7] ..... E03C 1/24
(52) U.S. Cl. ..... 4/651; 4/654; 4/641
(58) Field of Search ..... 4/539, 639, 640, 4/641, 642, 638, 654, 517

(56) References Cited

U.S. PATENT DOCUMENTS

| | | | | |
|---|---|---|---|---|
| 2,988,775 A | | 6/1961 | Roland | 4/201 |
| 3,070,812 A | | 1/1963 | Skrmetta | 4/205 |
| 3,289,218 A | | 12/1966 | Mehilos | 4/206 |
| 4,128,905 A | | 12/1978 | Mathes | 4/187 |
| 4,370,762 A | | 2/1983 | Heil | 4/206 |
| 4,531,246 A | | 7/1985 | Earley | 4/629 |
| 4,648,140 A | | 3/1987 | Bogusz | 4/654 |
| 4,698,861 A | | 10/1987 | Bogusz | 4/654 |
| 5,377,941 A | * | 1/1995 | Har et al. | 248/101 |
| 5,435,022 A | | 7/1995 | Anderson | 4/641 |
| 5,680,929 A | * | 10/1997 | Von Seidel | 206/77.1 |

* cited by examiner

*Primary Examiner*—Gregory L. Huson
*Assistant Examiner*—Huyen Le
(74) *Attorney, Agent, or Firm*—Ernest V. Linek; Banner & Witcoff, Ltd.

(57) ABSTRACT

A sink attachment having a basin, a drain tube, and a sealing member is disclosed. The sink attachment provides for simultaneously draining tap water or other liquids and sealing the sink. The attachment may be relocated without having to remove the sealing member from the sink drain.

20 Claims, 5 Drawing Sheets

SINK ATTACHMENT

BACKGROUND OF THE INVENTION

1. Field of the Invention

The present invention relates to an attachment for sinks. Specifically, this invention relates to an attachment for a sink that provides an apparatus for draining water flowing from a tap while maintaining a sealed sink.

2. Background

Single basin sinks present several drawbacks with respect to washing articles in the sink. Once the sink drain is sealed, liquid flowing from a tap may not be drained. As the volume of liquid added to the sink increases the sink may begin to overflow. Therefore, during the article washing or rinsing process, the sink drain must be opened at regular intervals to reduce the volume of liquid in the sink. This process reduces the efficiency of washing or rinsing articles.

Several devices exist to avoid the problem described above. For example, an hourglass-shaped receptacle is described in U.S. Pat. No. 2,988,755. Other sink receptacles are described in U.S. Pat. Nos. 3,070,812, 3,289,218, 4,128,905, 5,435,022, 4,648,140 and 4,698,861. Each of these receptacles allow for draining of tap water while the sink is sealed, but each receptacle comprises a rigid immobile structure that occupies the center of the sink. Therefore, the location of these devices is not ideal, and the location may not be changed readily after the device is put into place without unsealing the sink.

A portable sink attachment is described in. U.S. Pat. No. 4,370,762 titled "Portable Attachment for Sinks." The device contains an upper wide mouth connected to an elbow that is relatively flat. The elbow is connected to a sealing means that plugs the sink. Unlike the previous devices, this device does not occupy the center of the sink. This device, however, is not attached to the sides of the sink.

Several means are known for attachment of devices to sinks. One such device is described in U.S. Pat. No. 4,531,246. The device has a cylindrical ring and removable means for attachment. The removable mounting means are positioned ninety degrees from each other and secure the device to the sink.

There exists a need in the art for a sink attachment that provides an apparatus for draining liquids while simultaneously sealing the sink. The device should require a minimum amount of sink space and should be securely, but removably, attached to the sink.

SUMMARY OF THE INVENTION

Now there is provided by the present invention a sink attachment that provides for draining of tap water while simultaneously sealing the sink. The device is mobile, flexible, removable and occupies limited space in the sink.

It is therefore, a principal object of the present invention to provide a sink attachment that fits into a sink and seals the drain of the sink effectively preventing any liquid in the sink from draining out. The use of this sink attachment allows the sink to be filled with a liquid, i.e. filled with soapy water to wash dishes, but provides an avenue for draining any liquid that flows from a tap, i.e. water that may be used to rinse the dishes.

In a first embodiment, the sink attachment comprises a basin, a drain tube, and a sealing member. The basin may be removably attached to the sink using an attaching member. The attaching. member may be any device or material that provides for reversible attachment including two sided tape, Velcro, magnets, or suction cups. Preferably the attaching member is suction cups. The drain tube and the basin are in communication, and a liquid-tight seal is created when the drain tube is connected to an opening in the basin. This liquid-tight seal prevents water from leaking out of the sink attachment and into the sink. The liquid-tight seal also prevents water in the sink from leaking into the sink attachment to prevent draining of the water from the sink. The method of connecting the drain tube to the basin may be any. method known to those skilled in the art. Preferably the drain tube is connected to the basin using one or more devices, such as fittings selected from the group consisting of compression fittings, PVC fittings, bulkhead fittings, flare fittings, and couplers. Optionally, the drain tube may be permanently fixed to the basin using adhesives or the like.

The drain tube is in communication with a sealing member. A liquid tight seal is also created between the drain tube and the sealing member. The drain tube is connected to the sealing member using one or more devices, such as the fittings and devices described hereinabove. The drain tube may also be attached to the sealing member using an adhesive.

The sealing member fits over the sink drain to retain water in the sink. The sealing member may be any apparatus that creates a liquid tight seal between the sealing member and the sink drain. More preferably the sealing member is any standard sink stopper or garbage disposal stopper. Most preferably the sealing member is a flat sink stopper or a garbage disposal stopper. Upon contacting the sink drain, the flat sink stopper and the garbage disposal stopper create a suction to prevent liquid from draining out of the sink.

The components of the sink attachment may be made from numerous materials. These materials include plastics, rubber, polymers, metals, Plexiglas®, glass, ABS, or combinations thereof. The metal material may be any metal material but is preferably a metal that is resistant to rusting and tarnishing, such as brass. Optionally, the metal may be galvanized or coated with a substance, such as Teflon, to prevent rusting and to increase the life of the sink attachment.

In a second embodiment, the basin further comprises a screen located in an opening in the basin. The screen prevents particulate matter from entering into the drain tube and potentially clogging the sink.

BRIEF DESCRIPTION OF THE DRAWINGS

These and other features and advantages of the present invention will become more apparent in view of the following detailed description in conjunction with the accompanying drawings, of which.

DETAILED DESCRIPTION OF THE PREFERRED EMBODIMENTS

The preferred embodiment of the present invention will be described herein with reference to illustrative embodiments of a sink attachment which follows.

Figure 1:
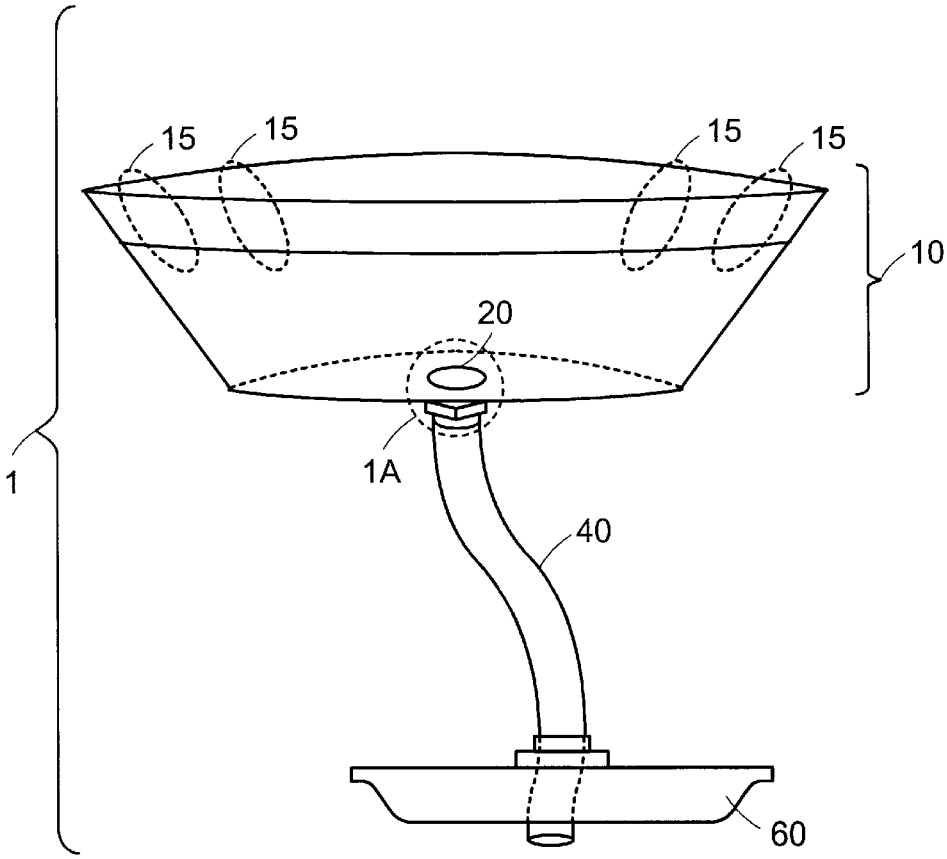
FIG. 1 is a side view of the sink attachment in accordance with the present invention.
Figure 1A:
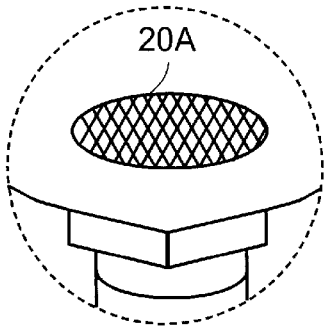
Figure 2:
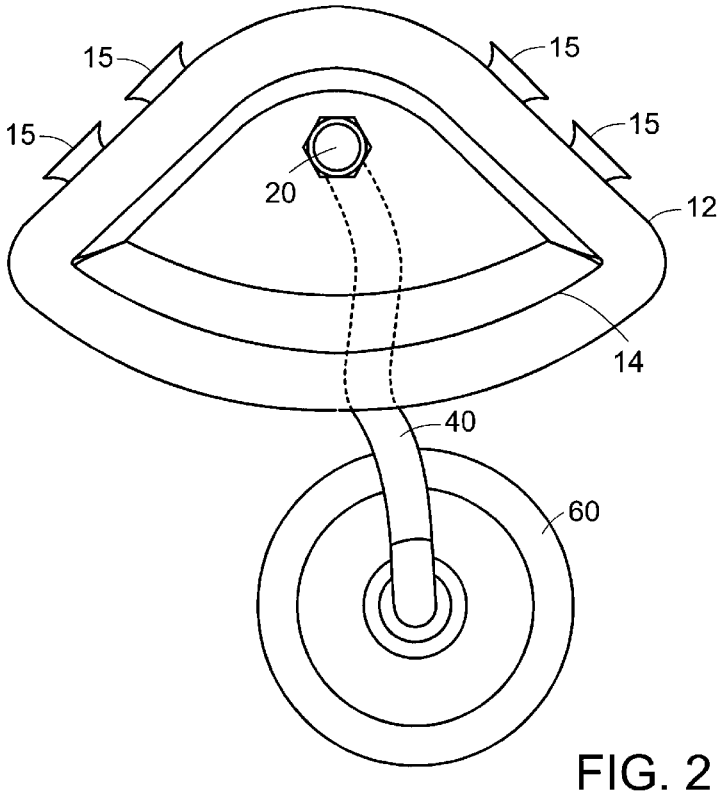
FIG. 2 is a top view of the sink attachment in accordance with the present invention.

Referring to FIG. 1 and FIG. 2, there is shown the sink attachment of the present invention generally referred to as numeral 1. The sink attachment comprises a basin 10 having at least one attaching member 15. The basin portion may comprise any geometric shape but is preferably shaped to fit into a corner of a standard kitchen sink. As used herein, standard kitchen sink means any kitchen sink used in the United States or in foreign countries. Preferably standard kitchen sink means those kitchen sinks used in homes and businesses throughout the United States.

The basin is preferably attached to the sides of the sink to facilitate washing of dishes or articles that are in the sink. Attachment of the basin to the sides of the sink maximizes the amount of space available for soaking or washing dishes or articles. The attaching member may be any apparatus that attaches the basin to one or more sides of the sink. The attaching member is preferably at least one small magnets or at least one suction cup. More preferably, the attaching member comprises a total of two suction cups where one suction cup is positioned on one face of the basin and the other suction cup is positioned on an adjacent face of the basin. Most preferably, the attaching member comprises a total of four suctions cups where two suction cups are positioned on one face of the basin and the other two suction cups are positioned on an adjacent face of the basin (see 15 in FIG. 2). One skilled in the art would recognize that other attaching members may be used to secure the basin to the sides of the sink.

Referring to FIG. 1, the lower portion of the basin comprises an opening 20. Attached to the opening 20 is a drain tube 40. The drain tube 40 connects to a sealing member 60 for sealing the drain of a sink. Therefore, the liquid flows into the basin, through the drain tube, and into the sink drain that is sealed by the sealing member. The sealing member may be any device that fits over the drain of a sink and creates a liquid tight seal. Most preferably the sealing member is a flat sink stopper or a garbage disposal stopper. Both the flat sink stopper and the garbage disposal stopper create a suction that prevents liquid from leaking out of the sink. Additionally, the flat sink stopper or the garbage disposal stopper is easily removed when the sink needs draining.

Figure 3:
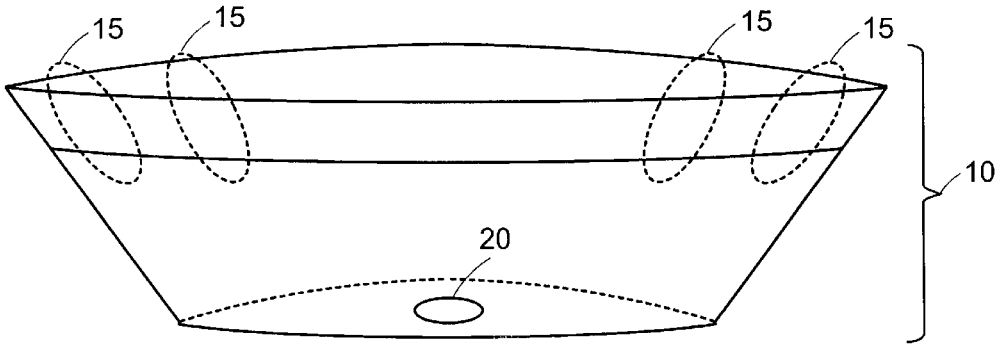
FIG. 3 is a side view of the basin of the sink attachment in accordance with the present invention.
Figure 4:
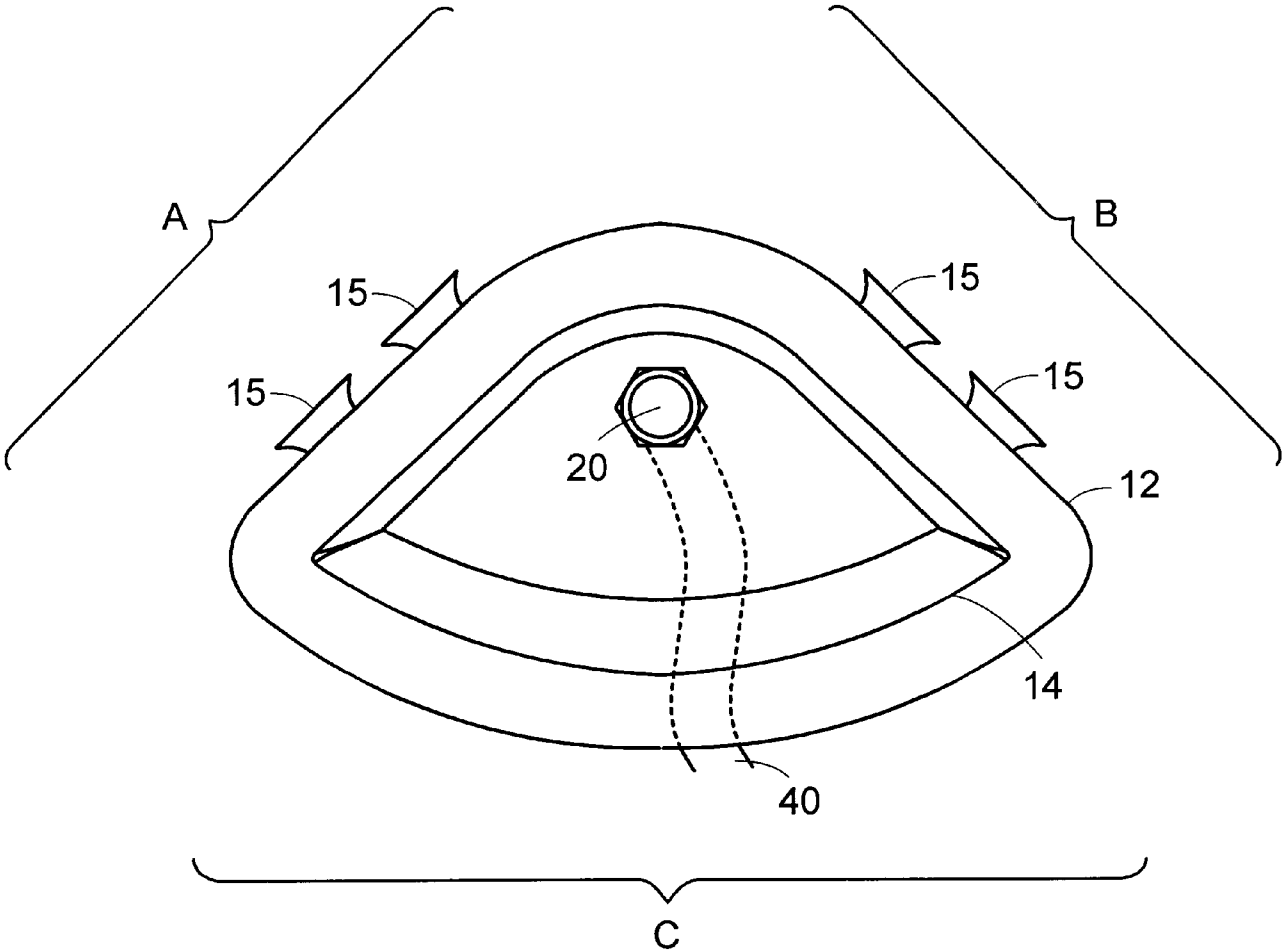
FIG. 4 is a top view of an embodiment of the basin of the sink attachment in accordance with the present invention.

Referring to FIG. 3 and FIG. 4, a first embodiment of a basin 10 is shown. The basin comprises an outer wall 12 and an inner wall 14. The basin and the walls may be made of any material. Preferably the basin and the walls are composed of material selected from plastics, rubber, polymers, metals, Plexiglas®, glass, ABS, or combinations thereof. The basin may have any geometric shape or dimensions capable of fitting into a corner of a sink. In a preferred embodiment, the basin 10 comprises three faces A, B, and C which form a triangular shape comprising round corners (see FIG. 4). In preferred embodiments, face C is approximately 5–12 inches long and faces A and B are each approximately 3–9 inches long. In the most preferred embodiment, face C is 8 inches long from corner to corner and faces A and B are each 5 inches long from corner to corner. One skilled in the art would recognize that the length of the sides may be altered to fit into any sink including sinks used in the United States as well as sinks used in foreign countries. Attached to sides A and B are at least one attaching member 15. More preferably attached to each side A and B is two attaching members. The attaching members located on sides A and B are in communication with the sides of the sink. Preferably the attaching members are suction cups. Side C faces outward towards the center of the sink. Since the sink attachment sits in the corner of the sink, the remaining portion of the sink is free for washing or rinsing articles.

The opening 20 of the basin comprises a fitting that extends below the basin for receiving a drain tube 40. In preferred embodiments, the fitting is threaded and capable of receiving a nut. In other preferred embodiments, the fitting is a plastic or glass connector capable of receiving a drain tube and creating a liquid tight seal without using a nut. Examples of such embodiments are the glass and polypropylene connectors that are commercially available from Fisher Scientific (Pittsburgh, Pa.), which are used for connecting pieces of tubing such as Tygon® tubing. The fitting may be attached to the basin using an epoxy, an adhesive, welding, soldering, or other methods that create a liquid tight seal between the fitting and the basin. The fitting may optionally be manufactured as an integrated part of the basin.

Figure 5:
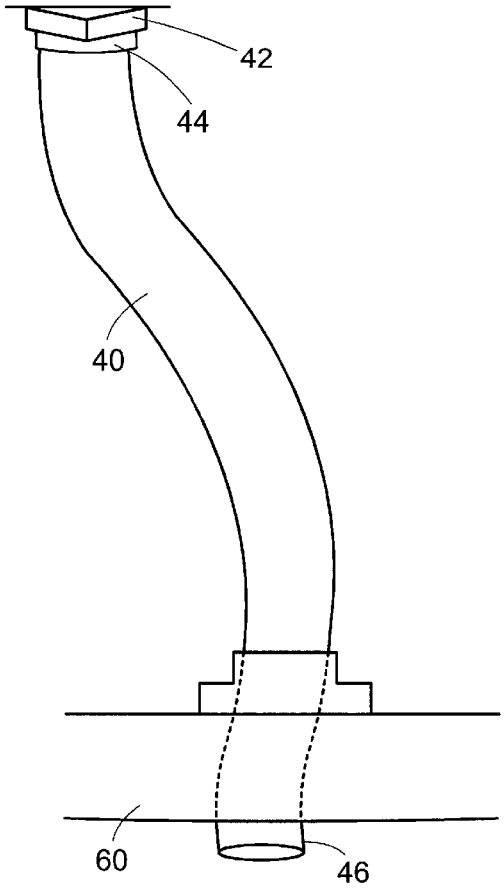
FIG. 5 is a side view of the drain tube in accordance with the present invention.

Referring to FIG. 5, a drain tube 40 comprising an upper end 44 and a lower end 46 is shown. The upper end 44 of the drain tube 40 attaches to the fitting of the basin. A liquid-tight seal is created by inserting the upper end 44 of the drain tube 40 into the drain fitting of the sink. In this embodiment, the drain tube is held in place using a nut 42. Optionally a washer may be inserted around the upper end 44 of the drain tube 40, prior to tightening the nut 42, to enhance the liquid-tight seal.

Figure 6:
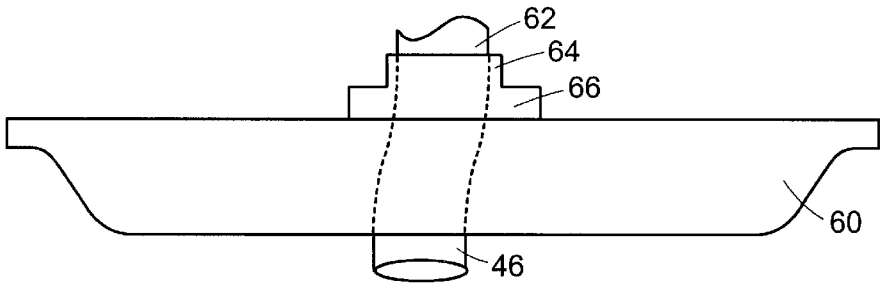
FIG. 6 is a side view of an embodiment of a sealing member in accordance with the present invention.
Figure 7:
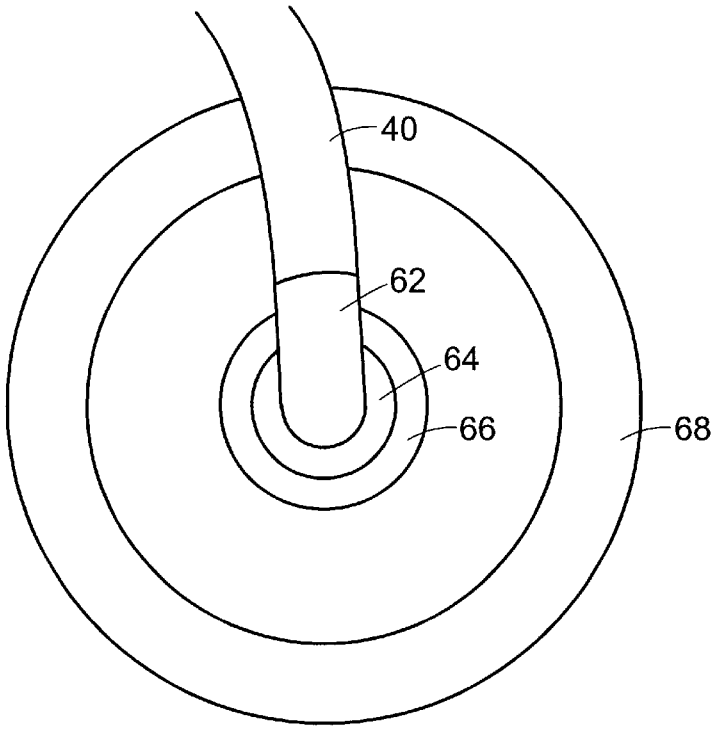
FIG. 7 is a top view of an embodiment of a sealing member in accordance with the present invention.

At the opposite end of the drain tube 40, the lower end 46 is in communication with the sealing member 60. Referring to FIG. 6 and FIG. 7, the lower end 46 couples to. a fitting 62 of the sealing member 60. Fitting 62 is preferably made of plastic, PVC, ABS, or other material that creates a liquid tight seal when the lower end 46 of the drain tube 40 is attached to the sealing member 60. Fitting 62 may comprise any or all of the fittings discussed herein including straight fittings, elbow fittings, and the like. Fitting 62 may be attached using an epoxy, an adhesive, welding, soldering or other methods that create a liquid tight seal between the fitting and the sealing member. The fitting may optionally be manufactured as an integrated part of the sealing member.

Figure 8:
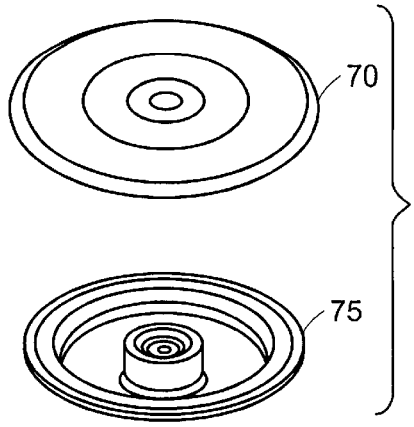
FIG. 8 is a perspective view of additional embodiments of a sealing member.

Several embodiments of a sealing member are shown in FIG. 8. A first embodiment of a sealing member comprises a flat sink stopper 70. A second embodiment of a sealing member comprises a standard garbage disposal stopper 75. One skilled in the art would recognize that different shapes and sizes of sealing members exist that may be used to create a liquid-tight seal between the sink drain and the sink attachment. For example, the technology described herein may be adapted for use in a sink comprising an ovoid shaped drain by providing an ovoid shaped sealing member.

Figure 9:
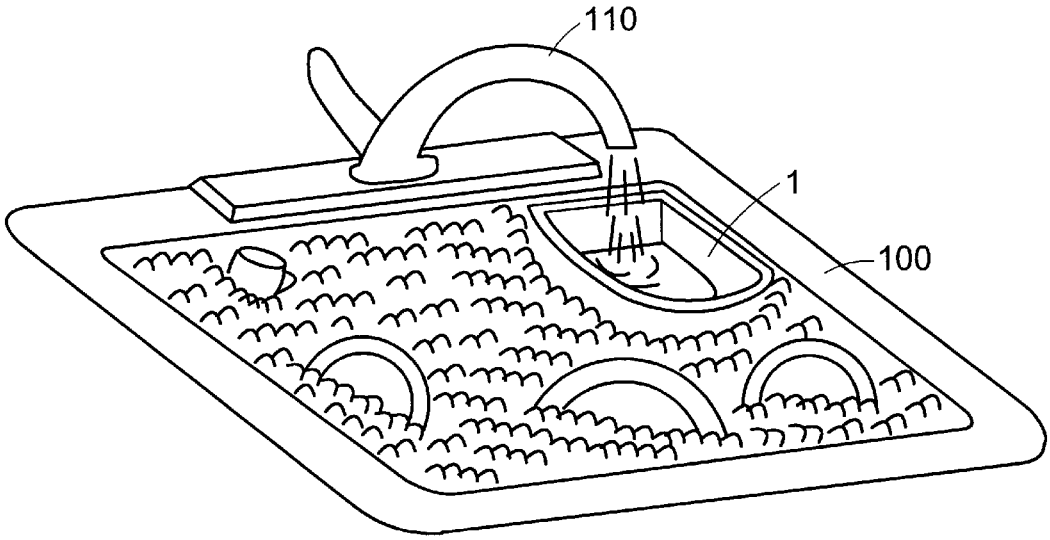
FIG. 9 is a perspective view of the sink attachment placed in a sink in accordance with the present invention.

Referring to FIG. 9, to use the sink attachment for washing dishes, the sealing member is first put into place over the drain of the sink. The basin is then attached to the sink 100 using the attaching member of the basin. The sink may then be filled with water, detergent, or other liquids. During the course of washing dishes, tap water may be used to rinse the dishes by placing a dish over the sink attachment and running water onto the dish and into the basin of the sink attachment. The rinse water drains through the sink attachment thus preventing loss of suds in the sink.

One skilled in the art would recognize that the sink attachment described herein may be used in any situation where a liquid holding vessel, such as a sink, comprises a single basin, and where more than one liquid must be used to complete the desired process. For example, the chemical industry might use the sink attachment for washing or rinsing glassware. Glassware may be placed into the sink for washing or soaking. The sink may then be filled with a detergent or a chemical solution, such as a basic solution, for washing the glassware. If a base bath is used, each piece of glassware may be placed above the sink attachment and rinsed with a neutralizing solution, such as a mild acid. The use of this sink attachment would prevent neutralization of the basic solution in the sink.

The attachment may also be used by the automotive industry. Many avenues of the auto repair industry require that residual material be removed from auto parts before installation into an automobile. The parts are often soaked in a hydrocarbon solution such as kerosene. The sink attachment may be used to rinse the auto parts after soaking in the kerosene bath. Therefore, any particulate matter in the hydrocarbon bath would not contaminate the parts.

Although the invention has been shown and described with respect to exemplary embodiments thereof, various other changes, additions and omissions in the form and detail thereof may be made therein without departing from the spirit and scope of the invention.

What is claimed is:

1. A sink attachment comprising:

a basin, at least one attaching member, the attaching member is attached to the basin, a sealing member, and a drain tube having a first end and a second end, the first end is connected to an opening in the basin, the second end is connected to an opening in the sealing member.

2. The sink attachment of claim 1, wherein the basin and the sealing member independently comprise fittings at the opening in the basin and the opening in the sealing member.

3. The sink attachment of claim 2, wherein the fittings are independently selected from the group consisting of straight fittings, elbow fittings, PVC fittings, compression fittings, bulkhead fittings, flare fittings, and couplers.

4. The sink attachment of claim 1, wherein the attaching member is selected from the group consisting of suction cups, magnets, tape, and Velcro.

5. The sink attachment of claim 1, wherein the basin comprises an inner wall, an outer wall, and a bottom surface.

6. The sink attachment of claim 5, wherein the basin has a triangular shape comprising round corners.

7. The sink attachment of claim 1, wherein the basin is made from a material selected from the group consisting of plastics, rubber, polymers, metals, Plexiglas, ABS, and glass.

8. The sink attachment of claim 1, wherein the drain tube is made from a material selected from the group consisting of plastics, rubber, polymers, metals, Plexiglas, ABS, and glass.

9. The sink attachment of claim 1, wherein the sealing member is from a material selected from the group consisting of plastics, rubber, polymers, metals, Plexiglas, ABS, and glass.

10. The sink attachment of claim 1, wherein the basin comprises a screen located in the opening in the basin, the screen prevents particulate matter from entering into the drain tube.

11. The sink attachment of claim 1, wherein the sealing member is a flat disc that engages the sink drain to form a liquid-tight seal.

12. The sink attachment of claim 1, wherein the sealing member is a flat sink stopper or a garbage disposal stopper.

13. A method of using a sink attachment comprising:

providing a sink attachment, the sink attachment comprising a basin, a least one attaching member, the attaching member is attached to the basin, a sealing member, and a drain tube having a first end and a second end, the first end is connected to an opening in the basin, the second end is connected to an opening in the sealing member, engaging a sink drain with the sealing member to create a liquid-tight seal, engaging the attaching member of the basin with at least one side of a sink, and filling the sink with a liquid.

14. The method of claim 13, further comprising:

disengaging the basin from the side of the sink by disengaging the attaching member, and reengaging the attaching member of the basin to different sides of the sink.

15. The method of claim 13, wherein the attaching member is selected from the group consisting of suction cups, magnets, tape, and Velcro.

16. The method of claim 13, wherein the basin comprises an inner wall, an outer wall, and a bottom surface.

17. The method of claim 13, wherein the basin, the drain tube, and the sealing member are independently made from a material selected from the group consisting of plastics, rubber, polymers, metals, Plexiglas, ABS, and glass.

18. The method of claim 13, wherein the basin comprises a screen located in the opening in the basin, the screen prevents particulate matter from entering into the drain tube.

19. The method of claim 13, wherein the sealing member is a flat disc that engages the sink drain to form a liquid-tight seal.

20. The method of claim 13, wherein the sealing member is a flat sink stopper or a garbage disposal stopper.

* * * * *